United States Patent [19]

Shigetoh

[11] Patent Number: 5,028,464

[45] Date of Patent: Jul. 2, 1991

[54] STRUCTURE OF GOLF CLUB SHAFT AND METHOD OF PRODUCING THE SHAFT

[75] Inventor: Hidetoshi Shigetoh, Fuchu, Japan

[73] Assignee: Ryobi Limited, Japan

[21] Appl. No.: 416,381

[22] Filed: Oct. 3, 1989

[30] Foreign Application Priority Data

Oct. 4, 1988 [JP] Japan ..... 63-251508

[51] Int. Cl.[5] ..... A63B 53/12

[52] U.S. Cl. ..... 428/35.9; 273/80 R; 273/80.3; 156/189; 156/190; 156/173; 428/36.1; 428/36.3

[58] Field of Search ..... 428/35.9, 36.3, 36.91, 428/36.1, 263, 457, 935, 937, 938; 156/189, 190, 191, 173; 273/80, 80.1, 80.2, 80.3, 80.4, 80.4–80.9

[56] References Cited

U.S. PATENT DOCUMENTS 3,771,973 11/1973 Miller ..... 29/195

4,757,997 7/1988 Roy ..... 273/80

*Primary Examiner*—James J. Seidleck

*Assistant Examiner*—Charles R. Nold

*Attorney, Agent, or Firm*—Oliff & Berridge

[57] ABSTRACT

A golf club shaft comprises a laminated tube constituting a main body of the shaft which is wound around the outer periphery of a mandrel, a transparent metallic layer wound around the outer periphery of the laminated tube and a resin coat such as epoxy resin formed on the outer periphery of the transparent metallic layer. The laminated tube is composed of a plurality of cloth prepreg sheets having different fiber orientations when wound around the mandrel. The transparent metallic layer is composed of a cloth prepreg sheet and a metallic surface. The cloth prepreg sheet is formed of a cloth of organic and/or inorganic fibers, which is made transparent after molding treatment, and formed by plating or depositing, on one surface of the cloth, metal such as titanium or the like and by impregnating epoxy resin or other thermosetting or thermoplastic resin into the thus formed cloth. The transparent metallic layer is wound around the laminated tube with the metallic surface disposed inside to oppose to the outer surface of the laminated tube. The resin coat is applied on the outer peripheral surface of the transparent metallic layer after grinding the surface as occasion demands.

8 Claims, 4 Drawing Sheets

STRUCTURE OF GOLF CLUB SHAFT AND METHOD OF PRODUCING THE SHAFT

BACKGROUND OF THE INVENTION

This invention relates to a structure of a golf club shaft particularly made of a fiber reinforced plastic material and a method of producing the golf club shaft.

There is known a golf club shaft prepared by applying a metallic plating on an outer periphery of a laminated tube or by winding a metallic fiber tape or metallic foil tape around the outer periphery of the laminated tube for the purposes of providing a fine outer appearance and improving the hardness of the surface of the golf club shaft and impact proof property thereof. The golf club shaft of the type described is disclosed, for example, in the Japanese Utility Model Laid-Open Publication No. 50-88050.

However, with the conventional golf club shaft of the character described, when the metallic plating is made on the outer periphery of the laminated tube, the plating is finely and uniformly applied to a portion at which the fibers are exposed, but the plating is not made uniformly to a portion which is covered by resin. A golf club shaft provided with an unevenly plated surface has a less quality for a commercial product of the apperance thereof.

In the meantime, the golf club shaft which is formed by winding the metallic fiber tape or foil tape around the outer periphery of the laminated tube may provide a relatively fine appearance and provide an improved surface hardness and impact proof property, whereas the entire weight of the golf club shaft is increased and the increasing of the entire weight of the golf club shaft is very significant problem for the golf club shaft even in view of the advantages mentioned above.

SUMMARY OF THE INVENTION

An object of this invention is to substantially eliminate the defects or drawbacks encountered to the prior art and to provide a golf club shaft having an improved structure providing an improved appearance and having an improved surface hardness and impact proof property and also provided a method of producing the golf club shaft of the character described above.

This and other objects can be achieved according to this invention in one aspect by providing a structure of a golf club shaft of the type formed of fibers of high strength and high modulus property and thermosetting or thermoplastic resin around a cylindrically tapered mandrel which is finally removed, comprising;

a laminated tube prepared by impregnating thermosetting or thermoplastic resin into organic and/or inorganic fibers or metallic fibers and winding the thus prepared impregnated fibers around the mandrel;

a transparent metallic layer having a metallic surface disposed on one side thereof prepared by impregnating thermosetting or thermoplastic resin into a cloth of organic and/or inorganic fibers which are made transparent after the formation and applying the impregnated cloth around an outer periphery of said laminated tube so that said metallic surface of the transparent metallic layer is disposed inside; and a resin coat applied to an outer surface of said transparent metallic layer.

In another aspect according to this invention, there is provided a method for producing a golf club shaft comprising the steps of:

preparing a mandrel of a cylindrically tapered configuration and removed finally after the formation of a golf club shaft structure;

winding, around an outer periphery of the mandrel, a laminated tube formed of a prepreg sheet prepared by impregnating thermosetting or thermoplastic resin into a fiber material of high strength and high modulus property and semi-drying the impregnated fiber material;

applying a transparent metallic layer to an outer periphery of said laminated tube, said transparent metallic layer being formed by depositing or plating a metallic element to a cloth of organic and/or inorganic fibers which are made transparent after the formation and impregnating the thermosetting or thermoplastic resin into the deposited or plated cloth, said transparent metallic layer being applied with a metallic surface disposed inside;

heating and hardening a laminated structure composed of said laminated tube and said transparent metallic layer;

applying a resin coat on an outer periphery of said transparent metallic layer; and removing said mandrel from the laminated structure.

In a preferred embodiment, the laminated tube is composed of a plurality of prepreg sheets cut out so as to have fiber orientations different from each other with respect to the axis of the mandrel when the prepreg sheets are laminated. The transparent metallic layer is composed of a cloth prepreg sheet with a metallic surface disposed inside so as to oppose to the outer surface of the laminated tube. The transparent metallic layer is formed in a spiral stripe or other desired shape.

According to this invention, a golf club shaft is formed with a transparent metallic layer prepared by a cloth prepreg sheet which is made transparent after the formation and the transparent metallic layer is provided with a metallic surface, thus providing a fine appearance even after a grinding operation of an outer surface of the shaft. The golf club shaft is composed of the laminated tube, the metallic surface and the cloth prepreg layer of high extensible property against the breakage, so that the impact proof property can be remarkably improved. The resin coat film applied on the outer surface of the metallic layer can provide a high surface hardness as well as fine apperarance.

DESCRIPTION OF THE PREFERRED EMBODIMENTS

Referring to FIGS. 1, 2, 11 and 12, a shaft 1 for a golf club according to this invention comprises a laminated tube 2 constituting a main body of the shaft 1, a transparent layer 3 wound around the outer periphery of the laminated tube 2 and a resin coat 4 such as epoxy resin formed on the outer periphery of the transparent metallic layer 3. The shaft 1 is generally formed of fibers of high strength and high modulus and thermosetting or thermoplastic resin.

The transparent layer 3 is composed of a cloth prepreg sheet 3*a* and a metallic surface 3*b* on its one side. The cloth prepreg sheet 3*a* is formed of a cloth of inorganic fibers such as glass and/or organic fibers such as polyester and polyethylene, which are made transparent after a molding treatment, and formed by plating or depositing, on one surface of the cloth, metal such as titanium, titanium nitride, aluminum, nickel, copper, or the like and by impregnating epoxy resin or other thermosetting or thermoplastic resin into the thus formed cloth. In this meaning, the transparent layer is called as a transparent metallic layer 3 hereinafter. The transparent metallic layer 3 is wound around the laminated tube 2 with the metallic surface 3*b* disposed inside to oppose to the outer surface of the laminated tube 2. The resin coat 4 is applied on the outer peripheral surface of the transparent metallic layer 3 after grinding the surface as occasion demands.

Figure 2:
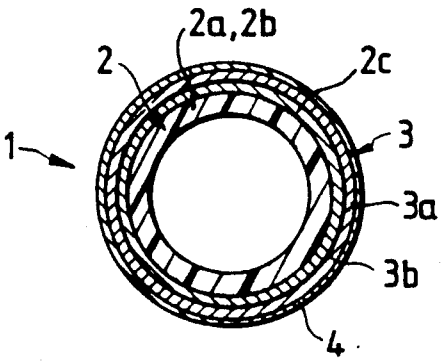
FIG. 2 is an enlarged sectional view taken along the line II—II shown in FIG. 1.
Figure 3:
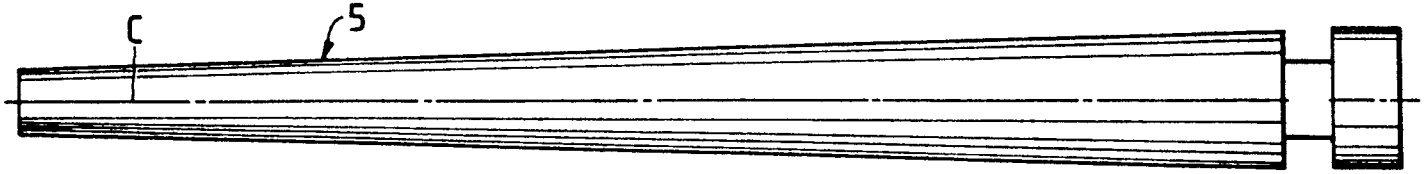
FIGS. 3 to 8 are side views of the golf club shaft in various steps of producing the same according to the first embodiment of this invention.
Figure 4A:
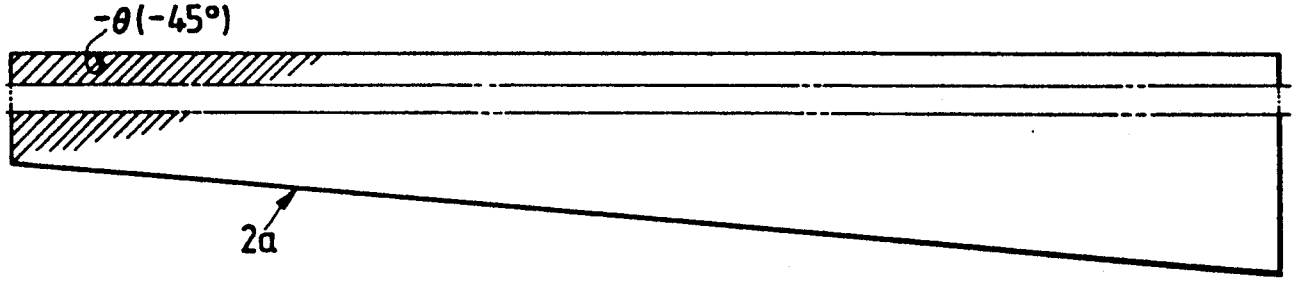
Figure 5:
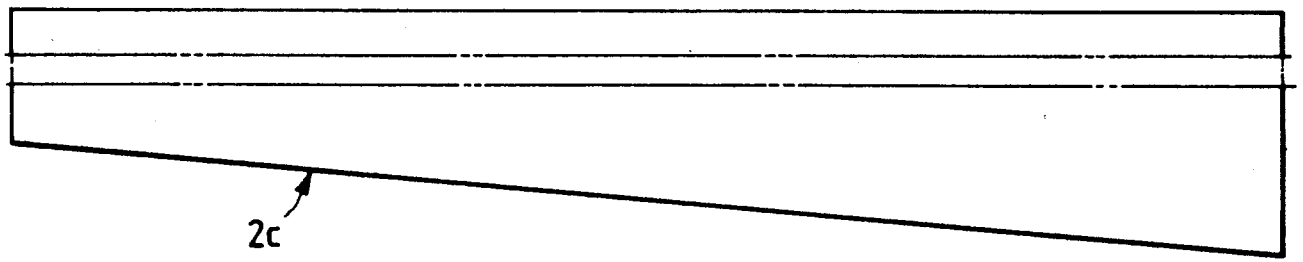
Figure 6:
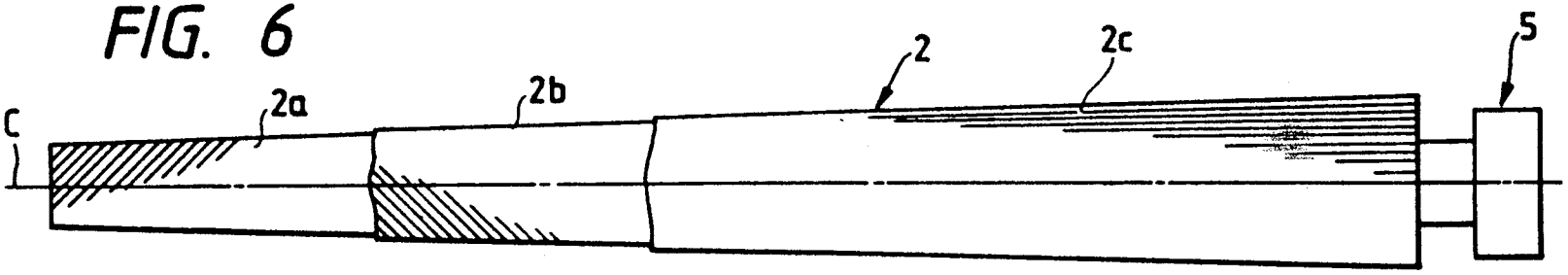

According to this invention, the laminated tube 2 may be composed of uni-directional prepreg layers of 2*a*, 2*b* and 2*c* laminated one by one in this order as shown in FIG. 2. The uni-directional prepreg sheet 2*a* is formed by impregnating epoxy resin by 33 wt. % into a material of TORAYCA T 300 of TORAY Industries, Inc., semi-drying the thus formed material into a graphite fiber epoxy prepreg sheet (product number 3053-15) and cutting out the graphite fiber epoxy prepreg sheet in a trapezoidal form as shown in FIG. 4*a* so that the fiber orientation of the thus cut out prepreg sheet constitutes $-\theta°$ (e.g. $-45°$) with respect to the axis C of a mandrel 5 as shown in FIG. 3. The mandrel 5 has a cylindrically tapered outer configuration and is utilized for winding the laminated tube around the outer periphery thereof to constitute the body of the golf club shaft structure. A mold release agent and a bonding agent are preliminarily applied to the outer surface of the mandrel 5, because the mandrel 5 should be removed after the golf club shaft has been formed. The uni-directional prepreg sheet 2*b* is formed of the graphite fiber epoxy prepreg sheet (product number 3053-15) and by cutting out the same in a trapezoidal form so that the fiber orientation of the thus cut out prepreg sheet constitutes $+\theta°$ (e.g. $+45°$) with respect to the axis C of the mandrel 5. The uni-directional prepreg sheet 2*c* is formed of a graphite fiber epoxy prepreg sheet (product number 3053-20) and by cutting out this graphite fiber epoxy prepreg sheet in a trapezoidal form, as shown in FIG. 5, so that the graphite fiber orientation is made parallel (0°) to the axis C of the mandrel 5.

In other words, the prepreg sheet 2*a* is first wound around the outer periphery of the mandrel so that the graphite orientation thereof constitutes $-45°$ with respect to the axis C of the mandrel 5, the prepreg sheet 2*b* is then wound around the outer periphery of the prepreg sheet 2*a* so that the graphite orientation thereof constitutes $+45°$ with respect to the axis C, and the prepreg sheet 2*c* is finally wound around the outer periphery of the prepreg sheet 2*b* so that the graphite orientation thereof is made parallel to the axis C.

The transparent metallic layer 3 is formed in the following manners with reference to FIGS. 7 to 12.

Figure 7:
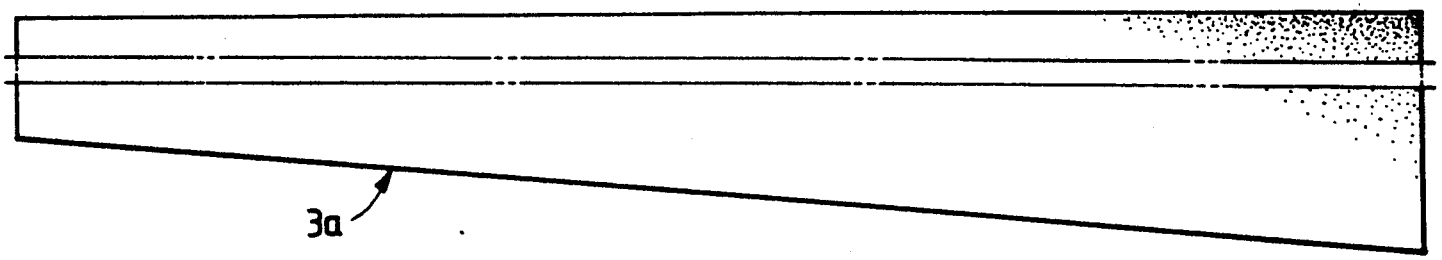
Figure 8:
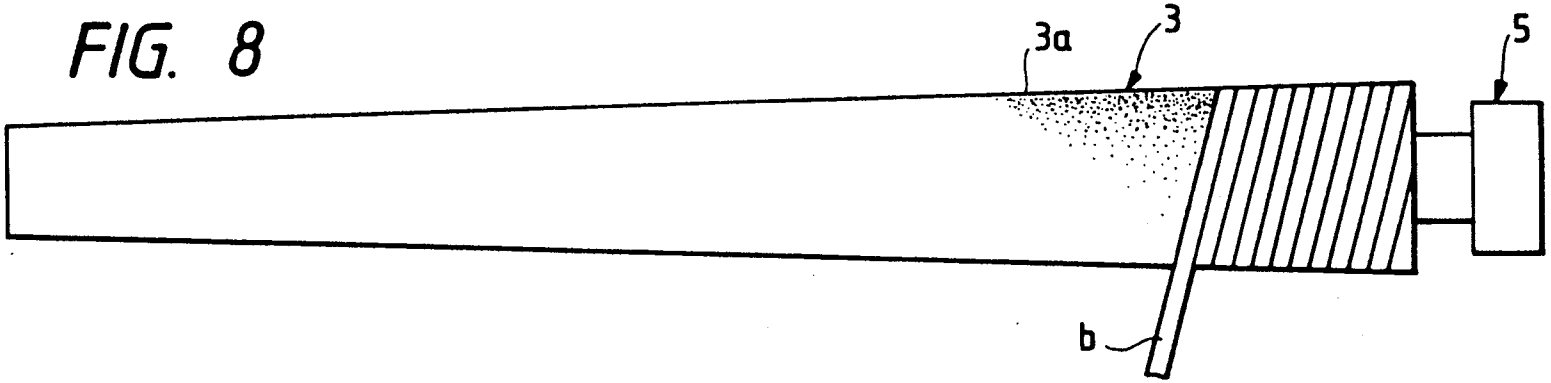

Referring to FIG. 7, the cloth prepreg sheet 3*a* is cut out in a trapezoidal form and the thus cut out prepreg sheet is wound around the entire outer periphery of the laminated tube 2 and along the entire length thereof with the metallic surface 3*b* disposed inside. Then, a polypropylene tape 6 formed by stretching or drawing it biaxially is wound around the cloth prepreg sheet 3*a* as shown in FIG. 8.

Figure 9:
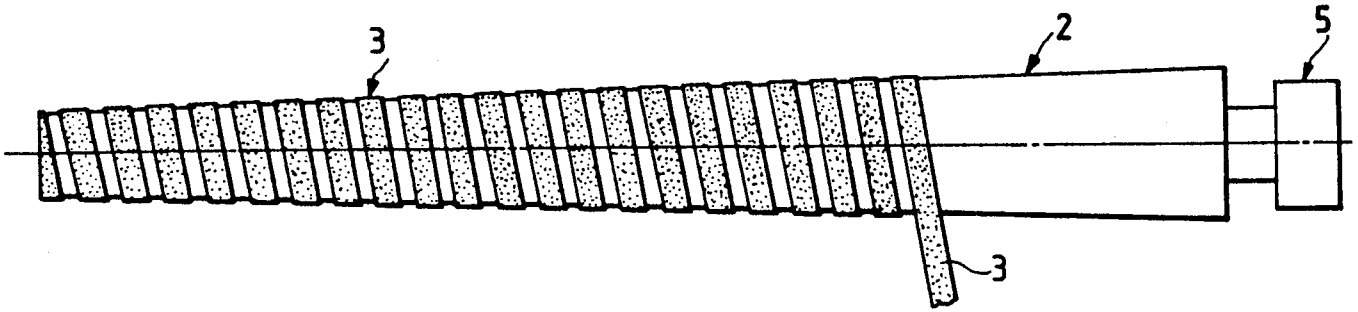
FIG. 9 is a side view of the golf club shaft in one step of producing the same according to the second embodiment of this invention.

Referring to FIG. 9, a cloth prepreg sheet tape 3*c* prepared by slitting the cloth prepreg sheet 3*a* is wound in a spiral form around the outer periphery of the laminated tube 2 with the metallic surface 3*b* disposed inside. The cloth prepreg sheet 3*a* may otherwise be wound partially or with spaces around the outer periphery of the laminated tube 2.

Figure 10:
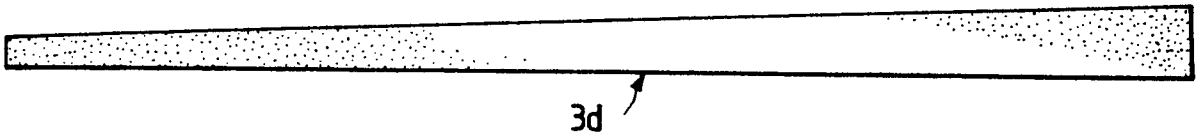
FIGS. 10 and 11 are side views of the golf club shaft in the steps of producing the same according to the third embodiment of this invention.
Figure 11:
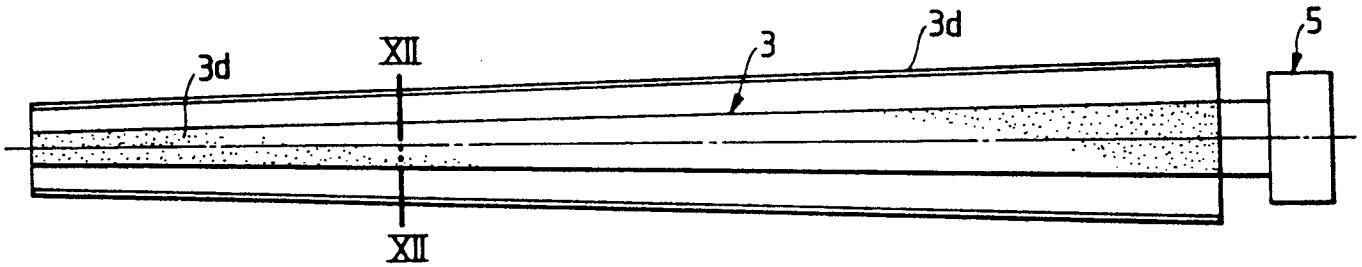
Figure 12:
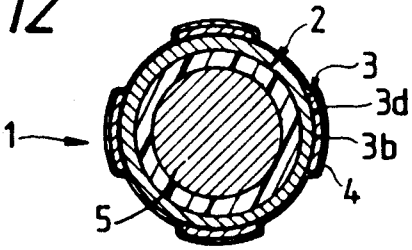
FIG. 12 is an enlarged sectional view taken along the line XIII—XIII shown in FIG. 11.

Referring to FIGS. 10 to 12, a cloth prepreg sheet 3*d* cut out in a trapezoidal form is applied to the outer surface of the laminated tube 2 in shape of stripe.

The metallic layer thus applied to the outer surface of the laminated tube 2 is then subjected to a heat setting treatment.

Furthermore, FIGS. 7 to 11 represent the production method of the golf club shaft 1 of the characters described above according to this invention and the production method will be described in detail hereunder by way of concrete examples.

EXAMPLE 1

Figure 4B:
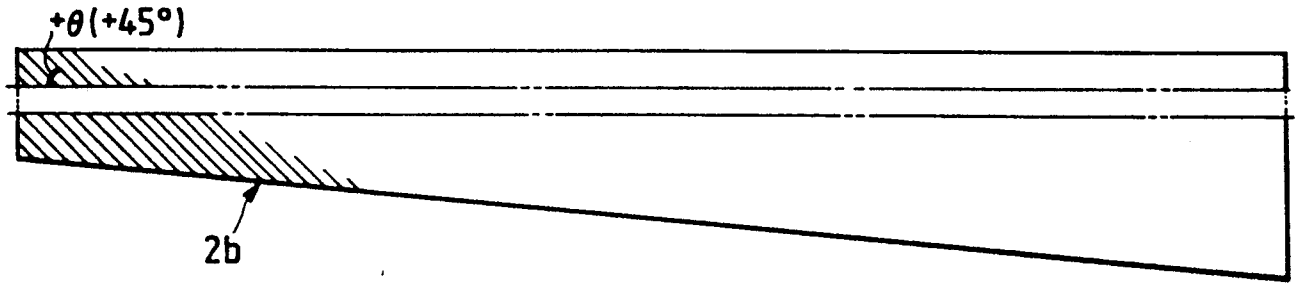

1. A cylindrically tapered mandrel shown in FIG. 3 was prepared so as to have a diameter of the tip thereof $d'=12.49$ mm, a diameter of the butt thereof of $d=50.8$ mm, and an effective axial length of $L=1140$ mm. Laminated prepreg layers of 2*a* and 2*b* were bonded to the outer surface of the mandrel 5 on which the mold release agent and the bonding agent were preliminarily applied and were wound therearound under a pressure of 600 kg. The prepreg sheet 2*a* was prepared by impregnating epoxy resin of 33 wt. % into a material of TORAYCA T 300 of TORAY and then semi-drying the same to obtain a semi-dried graphite fiber epoxy prepreg sheet (product number 3053-15), which was thereafter cut out into a trapezoidal form, as shown in FIG. 4*a*, with a width of a front end portion corresponding to the tip of the mandrel 5 of $b'=57$ mm, a width of a base end portion corresponding to the butt of the mandrel of $b=126$ mm and an axial length of $L=1140$ mm so that the fiber orientation of the graphite fiber constitutes $-45°$ with respect to the axis C of the mandrel 5 when it is wound around the mandrel 5. The prepreg sheet 2*b* was prepared by cutting out the graphite fiber epoxy prepreg sheet (product number 3053-15), as shown in FIG. 4*b*, into a trapezoidal form having the same sizes as those of the prepreg sheet 2*a* so that the fiber orientation of the graphite fiber constitutes $+45°$ with respect to the axis C of the mandrel when it is wound therearound. A prepreg sheet 2*c* was further prepared by cutting out the graphite fiber epoxy prepreg sheet (product number 3053-20) into a trapezoidal form, as shown in FIG. 5, with a width of a front end portion of $b'=70$ mm, a width of a base end portion of $b=140$ mm and an axial length of $L=1140$ mm so that the fiber orientation of the graphite fiber is made parallel to the axis C of the mandrel 5 when it is wound around the outer periphery of the laminated layers 2a and 2b under a pressure of 400 kg. In this manner, a laminated tube 2 was formed.

2. A metallic surface 3b was formed by depositing or evaporating titanium on one surface of a glass cloth (NITTOBO WE-05E 50 g/m$^2$) woven by glass fiber so as to have a thickness of the titanium film of 3$\mu$. Thereafter, a cloth prepreg sheet was prepared by impregnating epoxy resin of 32 wt. % into the glass cloth and then semi-drying or hardening the impregnated material (thickness after formation: 0.04 mm). The cloth prepreg sheet was cut out in a trapezoidal form, as shown in FIG. 7, having a front end width of b'=27 mm, a base end width of b=53 mm and an axial length of L=1140 mm, to thereby obtain the cloth prepreg sheet 3a. The cloth prepreg sheet 3a was wound around the outer periphery of the laminated tube 2 under a pressure of 400 kg with the metallic surface 3b disposed inside. A biaxially orientated polypropylene tape 6 having a thickness of 40$\mu$ and a width of 15 mm was wound around the outer periphery of the cloth prepreg sheet 3a with a pitch of 2 mm and under a pressure of 5 kg. The thus prepared cloth prepreg sheet 3a with the polypropylene tape 6 was then heated and hardened for two hours at a heating temperature of 130° C. The transparent metallic layer 3 can thus be prepared.

Figure 1:
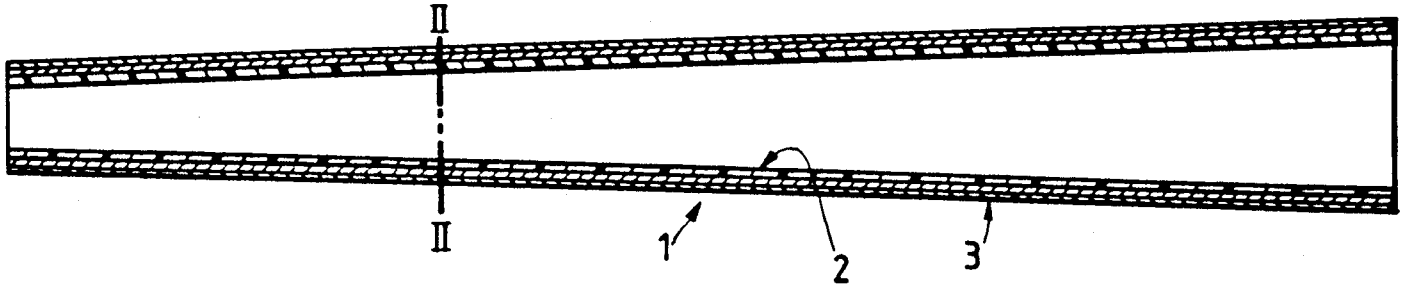
FIG. 1 is a sectional side view of a golf club shaft having a structure according to this invention.

3. Both ends of a cylindrical member for a golf club shaft 1 prepared by the step 1 and 2 described above was cut so as to have an entire axial length of l=1120 mm and the outer peripheral surface of the transparent metallic layer 3 was ground by a wet grinding treatment with an endless paper #600, as occasion demands, to obtain a smooth outer surface. Thereafter, epoxy resin or polyurethane resin was coated on the thus treated surface to form a resin coat film 4. A golf club shaft 1 according to this invention was obtained by carrying out the above described steps. The golf club shaft 1, as shown in FIG. 1, has a diameter of the tip of D'=$\phi$7.9 mm, a diameter of the butt of D'=$\phi$15.2 mm, a flexibility of 150 mm, a weight of 85 g, and an axial length of l=1120 mm. The outer surface of the shaft 1 exhibited a titanium color (plated color). The flexibility was measured in the following manner. First, the shaft 1 was supported at a position of 92 cm from its tip. Then, a weight of 3 kg was suspended at a position of 10 cm from the tip. The distance through which the tip was lowered was the flexibility.

EXAMPLE 2

1. A laminated tube 2 was prepared by substantially the same step as the step 1 mentioned above with respect to the example 1.

2. A cloth prepreg tape 3c prepared by slitting the glass cloth prepreg sheet formed in the step 2 of the example 1. The tape 3c had a width of 5 mm. The tape 3c was wound around the outer periphery of the laminated tube 2 with the metallic surface 3b disposed inside with a pitch of P=8 mm and under a tensile force of 3 kg as shown in FIG. 9. Substantially the same treatments as those mentioned with respect to the step 2 of the example 1 were performed to prepare the transparent metallic layer 3.

3. A golf club shaft 1 of this embodiment was produced by substantially the same step as that of the example 1. The golf club shaft 1 has a diameter of the tip of D=$\phi$7.9 mm, a diameter of the butt of D=$\phi$15.2 mm, a flexibility of 150 mm, a weight of 84 g, and an axial length of l=1120 mm. The thus produced golf club shaft 1 exhibited an outer appearance of titanium color (plated color) with a spiral pattern.

EXAMPLE 3

1. A laminated tube 2 was prepared by substantially the same step as the step 1 mentioned above with respect to the example 1.

2. Four cloth prepreg sheets 3d prepared by cutting out the glass cloth prepreg sheet formed in the step 2 of the example 1 into isosceles trapezoidal pieces each having a front end width of C=3 mm, a base end width of C=7 mm, and an axial length L=1140 mm were applied to the outer periphery of the laminated tube 2 so as to extend in its longitudinal direction with the metallic surface 3b disposed inside as shown in FIGS. 11 and 12. The four sheets were preliminarily set around the peripheral surface of the laminated tube 2 with an equal space in its circumferential direction. The cloth prepreg sheets 3d were thereafter polymerized integrally on the outer surface of the laminated tube with a tensile force of 200 kg. Substantially the same treatments as those mentioned with respect to the step 2 of the example 1 were performed to prepare the transparent metallic layer 3 in a stripe form.

3. A golf club shaft 1 of this example was produced by substantially the same step as the step 3 of the example 1. The golf club shaft 1 has a diameter of the example 1. The golf club shaft 1 has a diameter of the tip of D=$\phi$7.9 mm, a diameter of the butt of D=$\phi$15.2 mm, flexibility of 150 mm, a weight of 84 g, and an axial length of l=1120 mm. The thus produced golf club shaft 1 exhibited an outer appearance of a titanium color (plated color) with a stripe pattern.

The golf club shaft according to this invention is not limited to the described embodiment and the following modifications may be made.

The golf club shaft according to this invention may be formed so that the tip to which an impact due to the striking of a golf ball is applied has a relatively large thickness and the butt is made thiner than the tip. The transparent metallic layer may be eliminated for a grip portion of the golf club shaft. The spirally winding pitches of the cloth prepreg sheet 3c may be made tight at the tip and coarse at the butt of the golf club shaft. The stripe winding manner may be made so that the cloth prepreg sheet 3c is overlapped at the tip and wound in a stripe or with spaces or in a stream line shape at the butt of the golf club shaft. The metallic plated layer of depositted layer may be formed so as to have a thickness of 1 to several $\mu$, or the cloth may be made extremely thin, to thereby reduce the entire weight of the golf club shaft.

What is claimed is:

1. A golf club shaft formed of fibers of high strength and high modulus property and thermosetting or thermoplastic resin around a cylindrically tapered mandrel which is removed after the structure of the shaft is formed therearound, comprising:

a laminated tube prepared by impregnating thermosetting or thermoplastic resin into at least one of organic and inorganic fibers and winding the thus prepared impregnated fibers around the mandrel;

a transparent layer having a metallic surface disposed on one side thereof, the transparent layer prepared by impregnating thermosetting or thermoplastic resin into a cloth of at least one or organic and inorganic fibers and wrapping the impregnated cloth around the outer periphery of said laminated tube so that said metallic surface of the transparent metallic layer is disposed inside to oppose the outer surface of the tube; and a resin coat applied to an outer surface of said transparent layer.

2. A golf club shaft according to claim 1, wherein said transparent layer comprises a cloth prepreg sheet with metallic surface, said cloth prepreg sheet being prepared by depositing a metallic substance on a cloth, impregnating epoxy resin into said cloth and semi-drying the thus impregnated cloth, and cutting the impregnated cloth in a trapezoidal form so as to form a fiber prepreg sheet, said transparent layer being wound around the outer periphery of said laminated tube.

3. A golf club shaft according to claim 1, wherein said transparent layer comprises a cloth prepreg tape with a metallic surface on one side, said cloth prepreg tape being formed by slitting a prepreg sheet which is prepared by depositing a metallic substance onto a cloth and impregnating epoxy into said cloth and winding said tape on said laminated tube in a spiral manner with said metallic surface disposed inside to oppose the outer surface of the tube.

4. A golf club shaft according to claim 1, wherein said transparent layer comprises a plurality of cloth prepreg sheets each having a metallic surface disposed on one side thereof, each of said cloth prepreg sheets being prepared by depositing a metallic substance onto a cloth, impregnating epoxy resin into the cloth and semi-drying the thus impregnated cloth, said cloth being cut out in an isosceles trapezoidal form and being applied on the outer surface of said laminated tube with an equal space in a circumferential direction of said tube, said metallic surface being disposed inside to oppose the outer surface of the tube when each sheet is applied on an outer periphery of said laminated tube.

5. A golf club shaft according to claim 1, wherein said laminated tube comprises a prepreg cloth having its fiber orientations of $\pm\theta°$ and an uni-directional prepreg sheet having its fiber orientation of 0°.

6. A golf club shaft according to claim 5, wherein said prepreg cloth of said laminated tube comprises a first prepreg sheet prepared by impregnating epoxy resin into a cloth and semi-drying the thus impregnated cloth to obtain a semi-dried fiber epoxy prepreg sheet, which is then cut out into a trapezoidal form so that fibers of the sheet are oriented at a certain angle with respect to an axis of the mandrel when wound around the mandrel, a second prepreg sheet prepared by cutting out the fiber epoxy prepreg sheet into a trapezoidal form having substantially the same size as that of the first prepreg sheet so that fibers of the sheet are oriented at a reversed angle with respect to the fibers of the first sheet, said uni-directional prepreg sheet comprising a third prepreg sheet prepared by cutting a fiber epoxy prepreg sheet into a trapezoidal form so that fibers of the sheet are oriented at an angle different from those of the first and second sheets, said first, second and third prepreg sheets being laminated in this order on the outer periphery of the mandrel.

7. A golf club shaft according to claim 6, wherein said first prepreg sheet is cut out into a trapezoidal form so that the fiber orientation thereof constitutes −45° with respect to an axis of the mandrel when wound around the mandrel, said second prepreg sheet being cut out into a trapezoidal form having substantially the same size as that of the first prepreg sheet so that the fiber orientation thereof constitutes +45° with respect to the axis of the mandrel when wound around the mandrel, said third prepreg sheet being cut out into a trapezoidal form so that the fiber orientation thereof is made parallel to the axis of the mandrel.

8. A golf club shaft according to claim 1, wherein said inorganic fibers are metallic fibers.

* * * * *